US007785027B1

(12) United States Patent
McKinley et al.

(10) Patent No.: US 7,785,027 B1
(45) Date of Patent: Aug. 31, 2010

(54) ELECTRONIC PENS WITH DYNAMIC FEATURES

(75) Inventors: Patrick A. McKinley, Corvallis, OR (US); Jeffrey S. James, Escondido, CA (US); Weston Myler, Albany, OR (US); Phillip Salvatori, Salem, OR (US)

(73) Assignee: Marvell International Ltd., Hamilton (BM)

( * ) Notice: Subject to any disclaimer, the term of this patent is extended or adjusted under 35 U.S.C. 154(b) by 123 days.

(21) Appl. No.: 12/140,220

(22) Filed: Jun. 16, 2008

Related U.S. Application Data

(60) Provisional application No. 60/944,278, filed on Jun. 15, 2007, provisional application No. 60/944,270, filed on Jun. 15, 2007, provisional application No. 60/944,264, filed on Jun. 15, 2007.

(51) Int. Cl.
*B43K 29/00* (2006.01)

(52) U.S. Cl. ..... 401/195; 401/32; 401/30; 401/29; 401/99; 345/179

(58) Field of Classification Search ..... 401/29–32, 401/195, 194, 99, 116, 117; 382/188, 189; 178/18.01–20.04; 345/179
See application file for complete search history.

(56) References Cited

U.S. PATENT DOCUMENTS 2,503,007 A * 4/1950 Steuck ..... 401/32
4,202,641 A * 5/1980 Tomura ..... 401/32
6,627,870 B1 * 9/2003 Lapstun et al. ..... 250/221

OTHER PUBLICATIONS

"Information technology—Telecommunications and information exchange between systems—Local and metropolitan area networks—Specific requirements—Part 11: Wireless LAN Medium Access Control (MAC) and Physical Layer (PHY) specifications", ISO/IEC 8802-11, ANSI/IEEE Std 802.11, New York, N.Y., Aug. 20, 1999, pp. 1-531.

"IEEE Standard for Information technology—Telecommunications and information exchange between systems—Local and metropolitan area networks—Specific requirements. Part 15.1: Wireless Medium Access Control (MAC) and Physical Layer (PHY) Specifications for Wireless Personal Area Networks (WPANs)", IEEE Std 802.15.1—2002, New York, N.Y., Jun. 14, 2002, pp. 1-1169.

* cited by examiner

*Primary Examiner*—David J. Walczak
*Assistant Examiner*—Keegan Gumbs

(57) ABSTRACT

An electronic pen includes a first and a second nib structure. A twist mechanism is coupled to the first and second nib structures to selectively extend the first or the second nib structure away from the twist mechanism in response to a rotational force. An inner cylinder is coupled to the twist mechanism, the inner cylinder having a first center axis and configured to rotate around the center axis to transfer the rotational force to the twist mechanism. An outer cylinder surrounds the inner cylinder and is coupled to the inner cylinder to move the inner cylinder in a rotational direction when the outer cylinder is rotated. The outer cylinder has a second center axis that is offset with respect to the first center axis of the inner cylinder.

23 Claims, 12 Drawing Sheets

10

ELECTRONIC PENS WITH DYNAMIC FEATURES

CROSS-REFERENCES TO RELATED APPLICATIONS

The present application claims priority to U.S. Provisional Patent Application No. 60/944,278A and 78B filed Jun. 15, 2007, entitled "Electronic Multi-Pen Twist Mechanism With An Axial Floating Attribute To Enable The Use Of A Single Dynamic Force Sensor With No Dependence on Which Pen Nib Is Deployed," U.S. Provisional Patent Application No. 60/944,270 filed Jun. 15, 2007, entitled "A Method To Simultaneously Select A Pen Nib And Indicate Selection In An Electronic Multi-Pen Application," and U.S. Provisional Patent Application No. 60/944,264 filed Jun. 15, 2007, entitled "Size Optimized Multi-Pen Twist Mechanism For Use In An Electronic Pen By Using An Oval Shaped Tip on An Off-Center Twist Mechanism With Off-Center Activation Linkage," the entire disclosures of which are hereby incorporated by reference in their entirety for all purposes.

TECHNICAL FIELD

Embodiments of the present invention relate to the field of writing devices, and more particularly, to electronic pens.

BACKGROUND

Electronic pens, otherwise known as digital pens or digital electronic pens, are writing implements that typically have certain writing capabilities and also include certain electronics such as, for example, imaging devices. These devices typically include a single ink cartridge, an imaging sensor such as a camera, electronic circuitry, and so forth. In some instances, these devices may also include electronics for wirelessly communicating with a computing device according to a communication standard such as 802.15 (i.e., WPAN) or other standards. When these devices are used by a user, these devices typically provide data to a computing device such as a personal computer. The data provided to the computing device may be used in order to record the drawing or writing strokes of the user or for other reasons.

For example, one way to use an electronic pen is to use it with a specially treated paper that has been formatted with embedded data that allows the computing device to track the movement of the pen, and more particularly, the nib of the pen, with respect to the paper. The paper may be printed with embedded data in the form of an array of dots that may be substantially or totally invisible to the naked eye. The dots are typically placed at regular intervals on the sheet. Additional microdots may also be printed around the larger dots that provide the locations of the dots with respect to the paper. When a user uses an electronic pen to write or draw on such a paper, the electronic paper using its image sensor may track its relative movement with respect to the paper by reading the embedded data that comes within the field of vision of the imaging sensor. In doing so, the relative writing or drawing strokes of the user may be captured.

Conventional electronic pens tend to be relatively big and bulky due to the presence of all the electronics that are needed in order to perform their basic functions. These devices are constrained to a limited number of functions or features. And because of the amount of electronics already included in these devices, there is minimal amount of space available for including additional components. As a result, these conventional electronic pens typically do not have extra space to hold additional ink cartridges, much less mechanisms for deploying the additional cartridges. There is known in the field of non-electronic traditional writing implementations (e.g., ballpoint pens), multi-pens or multi-ink pens that typically include multiple ink cartridges. Some of these multi-pens employ a twist mechanism to selectively extend or deploy each of the ink cartridges. However, such features are not available in current electronic pens because the space needed in the pen housing for such mechanisms or for the multiple cartridges is unavailable due to the large amount of space already taken up by the various electronics.

SUMMARY OF INVENTION

According to various embodiments of the present invention writing apparatuses are provided that may include one or more useful features. In some embodiments, a first apparatus is provided that may include a first nib structure including a first main body having a first and a second end, the first end being opposite the second end, and the first nib structure further including a first nib coupled to the first end, and a sensor coupled to the second end of the first nib structure to measure more than two levels of force being applied to the first nib. For these embodiments, the sensor may be a capacitive force sensor having a first plate and a second plate, the second plate being parallel to the first plate and being at a standoff distance away from the first plate. The first plate may have a first side that faces the second plate and a second side that is opposite of the first side and is coupled to the second end of the first nib structure.

In some embodiments, the first plate may be made of a material that is elastic to bend towards the second plate when the first nib structure transfers at least a portion of a force applied to the first nib. For these embodiments, the first and second plates comprise a conductive material. In some embodiments, the first apparatus may further comprise a support structure, and the second plate being fixed on the support structure.

In some embodiments, the first apparatus may further include a second nib structure including a second main body having a first end and a second end, the first end being opposite the second end, and a second nib coupled to the first end. For these embodiments, the first apparatus may further include a twist mechanism that is coupled to second ends of the first and the second main bodies, and the twist mechanism being further coupled to the first plate to transfer to the first plate at least portions of forces applied to the first or the second nib, the twist mechanism being configured to selectively extend the first or the second nib structures away from the twist mechanism.

In some embodiments, the first apparatus may include an imaging sensor, which may be a camera in some instances. In some embodiments, the first apparatus may further include at least one external barrel housing, and the sensor and the first nib structure being disposed within the at least one external barrel housing.

In some embodiments, a second apparatus is provided that includes a first nib structure, a second nib structure, a twist mechanism, an inner cylinder, and an outer cylinder. For these embodiments, the first nib structure includes a first main body having a first end and a second end, the first end being opposite the second end, and the first nib structure further including a first nib coupled to the first end. The second nib structure includes a second main body having a first end and a second end, the first end being opposite the second end, and a second nib coupled to the first end. The twist mechanism may be coupled to the second ends of the first and second nib structures to selectively extend the first or the second nib structure away from the twist mechanism. The inner cylinder may be coupled to the twist mechanism and having a first center axis, and the outer cylinder may surround the inner cylinder and may be coupled to the inner cylinder to move the inner cylinder in a rotational direction when the outer cylinder is rotated, the outer cylinder having a second center axis, and the first center axis of the inner cylinder being offset from the second center axis of the outer cylinder.

For these embodiments, the inner cylinder may include an external surface and a post that extends from the external surface outwards away from the first center axis, and the outer cylinder including an interior surface and one or more protrusions disposed on the interior surface and configured to engage the post to facilitate in the movement of the inner cylinder in the rotational direction. In some embodiments, at least a portion of the post may be disposed within the inner cylinder and may be coupled to a biasing component that exerts an outward force on the post urging the post towards the interior surface of the outer cylinder to maintain engagement of the post with the one or more protrusions. In some instances, the biasing component may be a spring.

In some embodiments, the second apparatus may further include an external barrel housing that surrounds at least the first and second main bodies of the first and second nib structures. For these embodiments, the second apparatus may also include an imaging sensor disposed within the external barrel housing. The second apparatus may also include circuitry disposed within the external barrel housing and coupled to the imaging sensor. In some embodiments, the first nib structure may be an ink cartridge. For these embodiments, the second nib structure may be another ink cartridge or a stylus.

In some embodiments, a third apparatus is provided that includes a first nib structure, a second nib structure, a twist mechanism, an inner cylinder, and a circuit board. For these embodiments, the first nib structure may include a first main body having a first end and a second end, the first end being opposite the second end, and the first nib structure further including a first nib coupled to the first end. The second nib structure may include a second main body having a first end and a second end, the first end being opposite the second end, and a second nib coupled to the first end. The twist mechanism may be coupled to the second ends of the first and second nib structures to selectively extend the first or the second nib structure away from the twist mechanism in response to a rotational force. The inner cylinder may be coupled to the twist mechanism, the inner cylinder having a center axis and configured to rotate around the center axis to transfer the rotational force to the twist mechanism, the inner cylinder further having an external surface and having a first and a second bridging contact disposed on the external surface. And the circuit board may include at least a first circuit to provide an indication that the first nib structure has been extended from the twist mechanism when the first circuit is a first closed circuit and a second circuit to provide an indication that the second nib structure has been extended from the twist mechanism when the second circuit is a second closed circuit, wherein the first bridging contact is configured to close the first circuit when the inner cylinder is rotated in a first rotational movement and the second bridging contact is configured to close the second circuit when the inner cylinder is rotated in a second rotational movement.

In some embodiments, the first circuit may include a first and a second trace that are separated by at least a first distance and the second circuit may include a third and a fourth trace that are separated by a second distance. For these embodiments, the first bridging contact may be disposed on the external surface of the inner cylinder and may have a width that is equal to or greater than the first distance and the second bridging contact may be disposed on the external surface of the inner cylinder and may have a width that is equal to or greater than the second distance.

In some embodiments, the first and second bridging contacts are a first and a second gradual ramp, respectively, disposed on the external surface of the inner cylinder, the first and second gradual ramps having elongated shapes that extend around the external surface of the inner cylinder and around the center axis of the inner cylinder. For these embodiments, each of the elongated shapes of the first and second gradual ramps may have a first and a second end, the first end having a first height with respect to the external surface and the second end having a second height with respect to the external surface, the first height being smaller than the second height.

In some embodiments, the first and second bridging contacts may comprise a conductive material. In some embodiments, the third apparatus may further include an outer cylinder that surrounds the inner cylinder and is coupled to the inner cylinder to move the inner cylinder in a rotational direction when the outer cylinder is rotated. For these embodiments, the third apparatus may further include an external barrel housing that surrounds at least the first and second main bodies of the first and second nib structures and the circuit board. In some embodiments, the third apparatus may also include an imaging sensor that is coupled to the circuit board.

In some embodiments, a fourth apparatus is provided that includes a first nib structure, a second nib structure, a twist mechanism, an inner cylinder, an outer cylinder, and a circuit board. For these embodiments, the first nib structure may include a first main body having a first end and a second end, the first end being opposite the second end, and the first nib structure further including a first nib coupled to the first end. The second nib structure may include a second main body having a first end and a second end, the first end being opposite the second end, and a second nib coupled to the first end. The twist mechanism may be coupled to the second ends of the first and second nib structures to selectively extend the first or the second nib structure away from the twist mechanism in response to a rotational force. The inner cylinder may be coupled to the twist mechanism, the inner cylinder having a first center axis and configured to rotate around the first center axis to transfer the rotational force to the twist mechanism, the inner cylinder further having an external surface and having a first and a second bridging contact disposed on the external surface. The outer cylinder may surround the inner cylinder and may be coupled to the inner cylinder to move the inner cylinder in a rotational direction when the outer cylinder is rotated, said outer cylinder having a second center axis, and the first center axis of the inner cylinder being offset from the second center axis of the outer cylinder. And the circuit board may include a first circuit to provide an indication that the first nib structure has been extended from the twist mechanism when the first circuit is a first closed circuit and a second circuit to provide an indication that the second nib structure has been extended from the twist mechanism when the second circuit is a second closed circuit, wherein the first bridging contact is configured to close the first circuit when the inner cylinder is rotated in a first rotational movement and the second bridging contact is configured to close the second circuit when the inner cylinder is rotated in a second rotational movement.

In some embodiments, the fourth apparatus may further include a sensor that is coupled to the twist mechanism to measure more than two levels of force being applied to the first or the second nib. For these embodiments, the sensor may be a capacitive force sensor having a first plate and a second plate, the second plate being parallel to the first plate and being at a standoff distance away from the first plate, the first plate having a first side that is facing the second plate and a second side that is opposite of the first side and coupled to the second end of the first nib structure.

In some embodiments, the inner cylinder may include an external surface and a post that extends from the external surface outwards away from the first center axis, and the outer cylinder including an interior surface and one or more protrusions disposed on the interior surface and configured to engage the post to facilitate in the movement of the inner cylinder in the first and second rotational directions. In some embodiments, the first circuit may include a first and a second trace that are separated by at least a first distance and the second circuit includes a third and a fourth trace that are separated by a second distance. For these embodiments, the first bridging contact may be disposed on the external surface of the inner cylinder and may have a width that is equal to or greater than the first distance and the second bridging contact may be disposed on the external surface of the inner cylinder and may have a width that is equal to or greater than the second distance.

In some embodiments, the first and second bridging contacts are a first and a second gradual ramp, respectively, disposed on the external surface of the inner cylinder, the first and second gradual ramps having elongated shapes that extend around the external surface of the inner cylinder and around the center axis of the inner cylinder.

These and other aspects of various embodiments of the present invention will be described in greater detail in the following description.

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION

In the following detailed description, reference is made to the accompanying drawings which form a part hereof wherein like numerals designate like parts throughout, and in which is depicted by way of illustration embodiments in which the invention may be practiced. It is to be understood that other embodiments may be utilized and structural or logical changes may be made without departing from the scope of the present invention. Therefore, the following detailed description is not to be taken in a limiting sense, and the scope of embodiments in accordance with the present invention is defined by the appended claims and their equivalents.

Various operations may be described as multiple discrete operations in turn, in a manner that may be helpful in understanding embodiments of the present invention; however, the order of description should not be construed to imply that these operations are order dependent.

For the purposes of the instant description, the phrase "A/B" means A or B. For the purposes of the instant description, the phrase "A and/or B" means "(A), (B), or (A and B)." For the purposes of the instant description, the phrase at least one of A, B and C" means "(A), (B), (C), (A and B), (A and C), (B and C) or (A, B and C)." For the purposes of the instant description, the phrase "(A)B" means "(B) or (AB)," that is, A is an optional element.

Reference in the specification to "some embodiments" or "various embodiments" means that a particular feature, structure, or characteristic described in connection with the embodiments is included in at least one embodiment. The appearances of the phrase "in one embodiment" in various places in the specification do not necessarily all refer to the same embodiment, but they may.

Embodiments of the present invention are directed to electronic pens that have components and structures that provide greater functionalities. In some embodiments, the electronic pen may include a dynamic pressure sensor to measure different levels of force that may be applied to the electronic pen when the electronic pen is being used by user to, for example, write. In the same embodiments or alternative embodiments, the electronic pens may include multiple nib structures such as one or more ink cartridges and/or one or more styluses. For these embodiments, the electronic pen may include particularly configured components that allow a user, using a twisting or rotational action, to select which of the nib structures to deploy. In some embodiments, these electronic pens with multiple nib structures may have components particularly designed and configured that provide sufficient space to accommodate all of the electronics needed in order to perform the various functionalities of the electronic pens. In some embodiments, the electronic pens may be designed to provide indications as to which of the nib structures has been deployed. These and other aspects of various embodiments of the present invention will be described herein.

Figure 1:
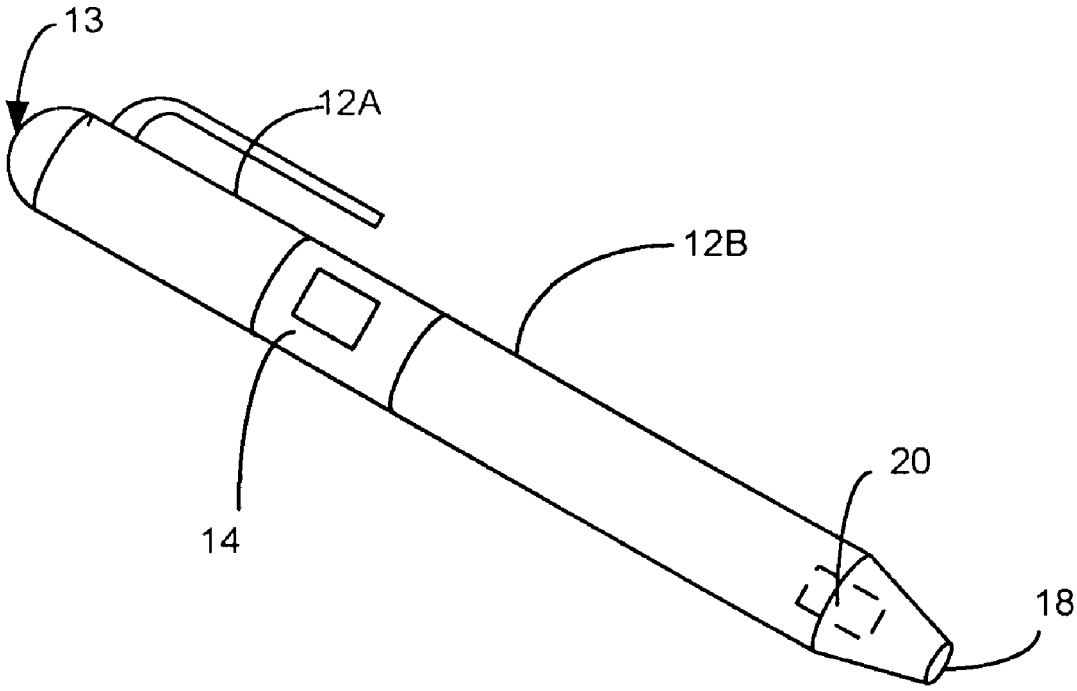
FIG. 1 illustrates an electronic pen, in accordance with various embodiments of the present invention.

FIG. 1 is an exterior view of an electronic multi-pen with a twist mechanism (herein "electronic pen") in accordance with various embodiments of the invention. The electronic pen 10 includes an external rear barrel housing 12A and external forward barrel housing 12B (which may be two separate pieces or a single unitary piece) and an outer twist ring or cylinder ("outer cylinder") 14. At one end of the external forward barrel housing 12B is an opening 18. Although not depicted, the external forward barrel housing 12B may further include an additional window or opening for an image sensor 20 that may be disposed within the external forward barrel housing 12B. In various embodiments, the outer cylinder 14 may be twisted or rotated by a user in order to selectively extend through the opening 18 each of the nibs of the nib structures that may be disposed within the external forward barrel housing 12B. The nib structures housed within the external forward barrel housing 12B may be one or more ink cartridges and/or one or more styluses. As briefly described earlier, within the external forward barrel housing 12B and near the opening 18 is an imaging sensor 20 (represented by a dotted rectangle). In some embodiments, the imaging sensor 20 may be a camera.

In some embodiments, the electronic pen 10 may be designed to wirelessly communicate with other electronic devices such as a personal computer or a printer via one of the communication interface standards such as Institute of Electrical and Electronic Engineers (IEEE) 182.11 standard (i.e., WiFi), IEEE 182.15 standard (i.e., Bluetooth™), or other standards. Alternatively, the electronic pen 10 may communicate with other devices via a wired connection. For these embodiments, the electronic pen 10 may include a USB port, which may be located, for example, at the distal end 13 of the external rear barrel housing 12A. Note that FIG. 1, as well as the other figures to be described herein may not be drawn to scale and are not meant to depict actual scaled versions of various embodiments of the present invention. Instead, the figures are provided for illustrative purposes only.

Figure 2:
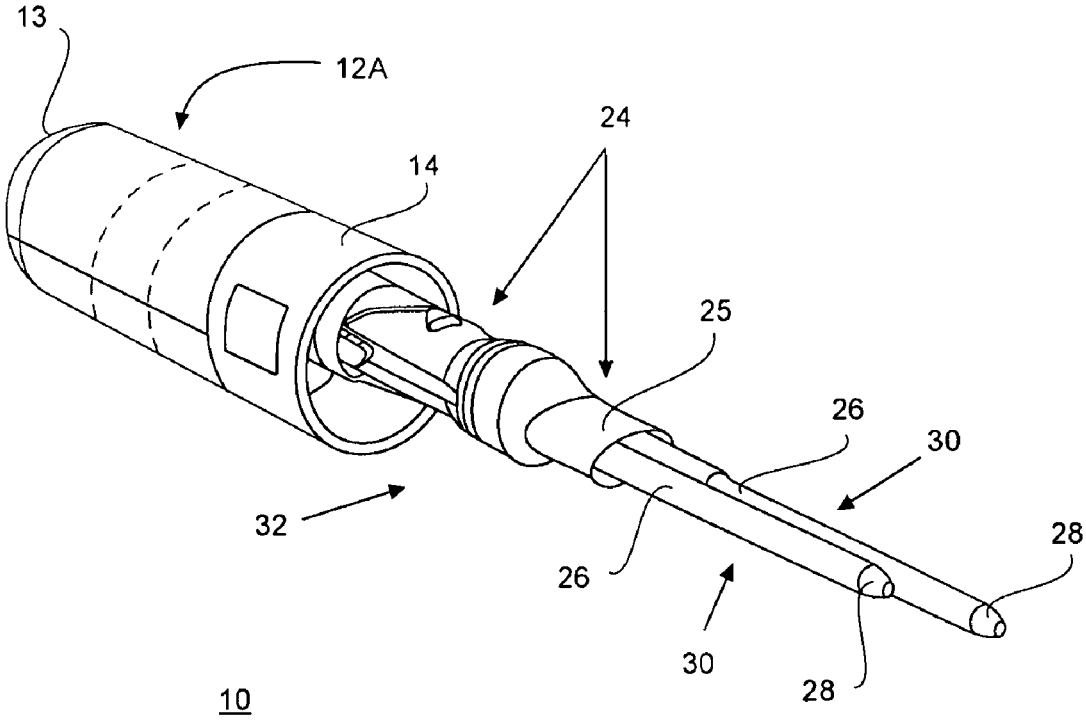
FIG. 2 illustrates some of the components of the electronic pen of FIG. 1, in accordance with various embodiments of the present invention.

FIG. 2 illustrates various components of the electronic pen 10 of FIG. 1 in accordance with various embodiments of the present invention. More particularly, FIG. 2 depicts some of the components of electronic pen 10 of FIG. 1 when the external forward barrel housing 12B has been removed. The electronic pen 10, in addition to the external rear barrel housing 12A and the outer cylinder 14, includes a twist mechanism 24 including an oval shaped twist mechanism housing sleeve 25, and two nib structures 30. Each of the nib structures 30 includes a main body 26 that may be an elongated piece, and a nib 28. The main body 26 includes a first and a second end, the second end being opposite of the first end, the first end being coupled to a corresponding nib 28, and the second end being coupled to the twist mechanism 24. In some embodiments, a nib structure 30 may be an ink cartridge, a stylus, or other writing implement. Although only two nib structures 30 are depicted in FIG. 2, in alternative embodiments, the electronic pen 10 may include more than two nib structures 30.

Figure 3:
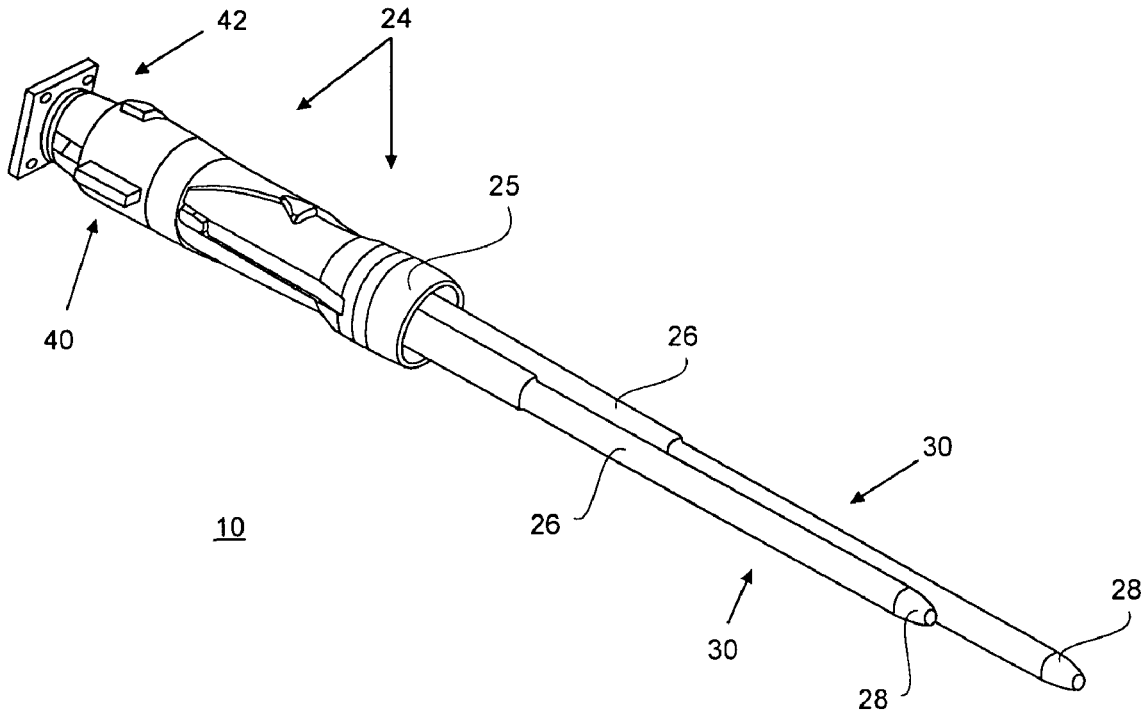
FIG. 3 illustrates more components of the electronic pen of FIG. 1, in accordance with various embodiments of the present invention.

As will be further described, the outer cylinder 14 may be rotatable around its center axis and may be coupled to the twist mechanism 24 via an inner ring or cylinder ("inner cylinder") 40 (see FIG. 3). Based on twisting forces (which may have been originally provided by a user) that may be translated from the outer cylinder 14 to the twist mechanism 24 via the inner cylinder 40, the twist mechanism 24 may extend each of the nib structures 30, one at a time, away from the twist mechanism 24, and extend their corresponding nib 28 through the opening 18 of the forward external barrel housing 12B. Since the twist mechanism 24 is well-known in field of writing implements, further discussions regarding the specific mechanics of the twist mechanism 24 will not be provided in the following description.

Various embodiments of the present invention may allow for more efficient use of space within the housing (i.e., forward and rear external barrel housings 12A and 12B and outer cylinder 14) of an electronic pen 10 that results in space 32 being created to accommodate various electronics. For these embodiments, the various electronics that may be included in the space 32 may include circuitry embodied in the form of, for example, a circuit board, and an imaging sensor 20.

Although not depicted, various other components may be included within the external rear barrel housing 12A. These components may include, for example, a power source such as a battery, and a communication interface including, for example, a radio transceiver. In some embodiments, a dynamic sensor for measuring dynamic forces that may be applied to the electronic pen 10 when, for example, the electronic pen 10 is being used by a user may be housed within the external rear barrel housing 12A as will be further described herein.

A conventional electronic pen, which includes a single nib structure (i.e., stylus or ink cartridge), typically uses a contact switch that detects whenever a force is being applied on the nib of the pen. When a force is applied to the nib, which may occur when a user uses the pen for writing, the contact switch acts in an On/Off manner to activate a circuitry in the pen. As a force is being applied to the end of such pens, the pen nib pushes to close, for example, a spring tab. This tab-to-metal contact closes a circuit which, in some instances, may "activate" the electronic pen. As a result, such a mechanism does not sense or measure dynamically changing force magnitudes. Further, such devices do not sense or measure dynamically changing force magnitudes. Thus, at most, these devices can only measure two levels of force: when there is no force being applied to the end of the pen; and when a force is being applied to the pen.

Accordingly, embodiments of the present invention provides for an electronic pen with a sensor that can dynamically measure multiple force variations of pen tip or paper during writing. In other words, to measure more than two levels of force being applied to the electronic pen. Such a sensor may be used in order to measure force being applied to an electronic pen with a single nib structure, similar to conventional electronic pens, or the force being applied to an electronic pen with multiple nib structures, such as the electronic pen 10 depicted in FIG. 2.

Referring to FIG. 3, which illustrates the electronic pen 10 of FIG. 2 when the external rear barrel housing 12A and the outer cylinder 14 have been removed, in accordance with various embodiments of the present invention. As more clearly shown in FIG. 3, the twist mechanism 24 is coupled to an inner cylinder 40, which will be further described below, and a dynamic force sensor assembly ("sensor assembly") 42 coupled to the twist mechanism 24.

Figure 4:
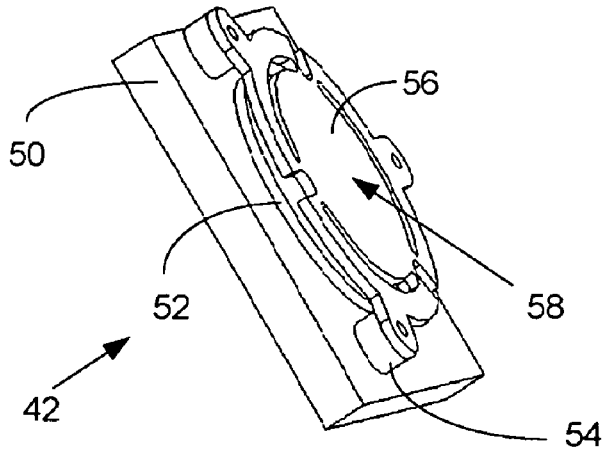
FIG. 4 illustrates a sensor assembly, in accordance with various embodiments of the present invention.
Figure 5:
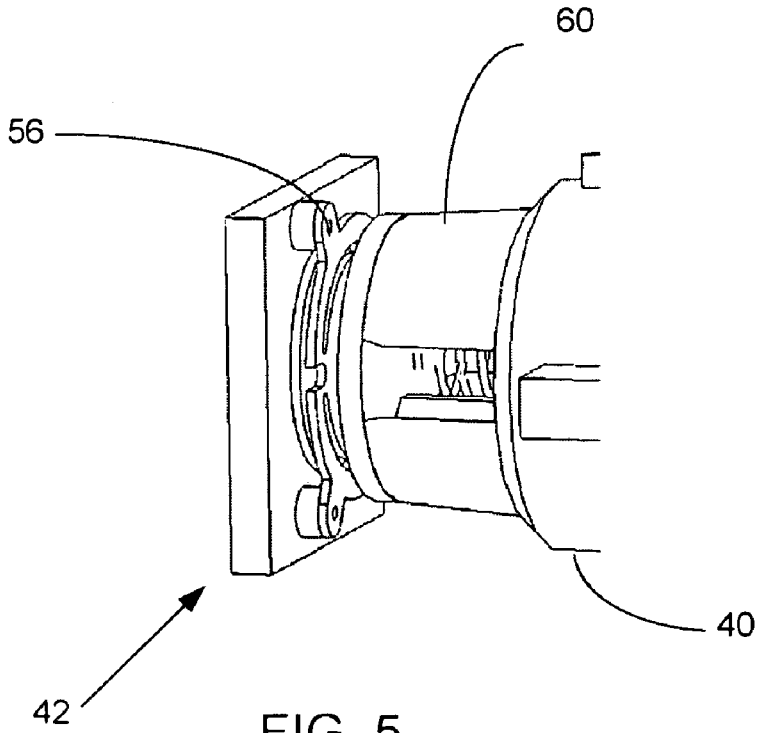
FIG. 5 illustrates the sensor assembly of FIG. 1 coupled to a twist mechanism base, in accordance with various embodiments of the present invention.

Turning now to FIG. 4, the sensor assembly 42 of FIG. 3 is illustrated in further detail, in accordance with various embodiments of the present invention. As depicted, the sensor assembly 42 may include a support structure 50, a sensing plate 52, standoffs 54, and a force plate 56. The sensing plate 52 and the force plate 56 may be parallel conductive plates that form a capacitive force sensor. More particularly, the sensing plate 52 may be fixed onto the support structure 50, and the force plate 56 may be supported at a determined standoff distance away from the sensing plate 52 by the standoffs 54. The force plate 56, as further depicted in FIG. 5, may be coupled to the twist mechanism 24 of the electronic pen 10 via twist mechanism base 60.

In various embodiments, the sensor assembly 42 may be employed in order to measure different levels of force that may be applied to the nibs 28, and more particularly, to the nib 28 that has been extended and deployed when the electronic pen 10 is being used by a user to write or draw. For example, when a user uses the electronic pen 10 to write on a sheet of paper, the user initially deploys (i.e., extends) one of the nib structures 30 by twisting the outer cylinder 14. As a result, the nib 28 of the deployed nib structure 30 may project out of the opening 18, which may then be placed onto the sheet. As the user begins to write, dynamically changing forces may be transferred to the nib 28 as a result of the user intentionally varying the force the user applies during the writing or because of the specific writing style of the user. The varying force being applied to the deployed nib 28 may then be translated through the corresponding main body 26 and the twist mechanism 24 to the force plate 56. The force plate 56, which may have certain elastic qualities, may be configured and shaped such that it may behave like a spring with the center portion 58 deflected towards the sensing plate 52 as a result of the force or forces being applied to it. As the distance between the force plate 56 and the sensing plate 52 varies, which may be proportional to the force being applied, the capacitance may be measured in the form of an analog signal that is proportional to the writing force being applied. This provides dynamic force measurements whenever any one of the nib structures 30 is used for writing. The sensing plate 52 and the force plate 56 may each be comprised of a conductive material or materials.

The ability to measure the dynamic forces being applied may be useful in numerous applications. For example, if the electronic pen 10 is being used to record and store a digitalized version of what is being written or drawn using the electronic pen 10, then the determination of the forces being provided may indicate the proper thickness or weight of the lines being drawn using the electronic pen 10. Other application for such determination may include, for example, the use of such determination in biometrics.

Figure 6:
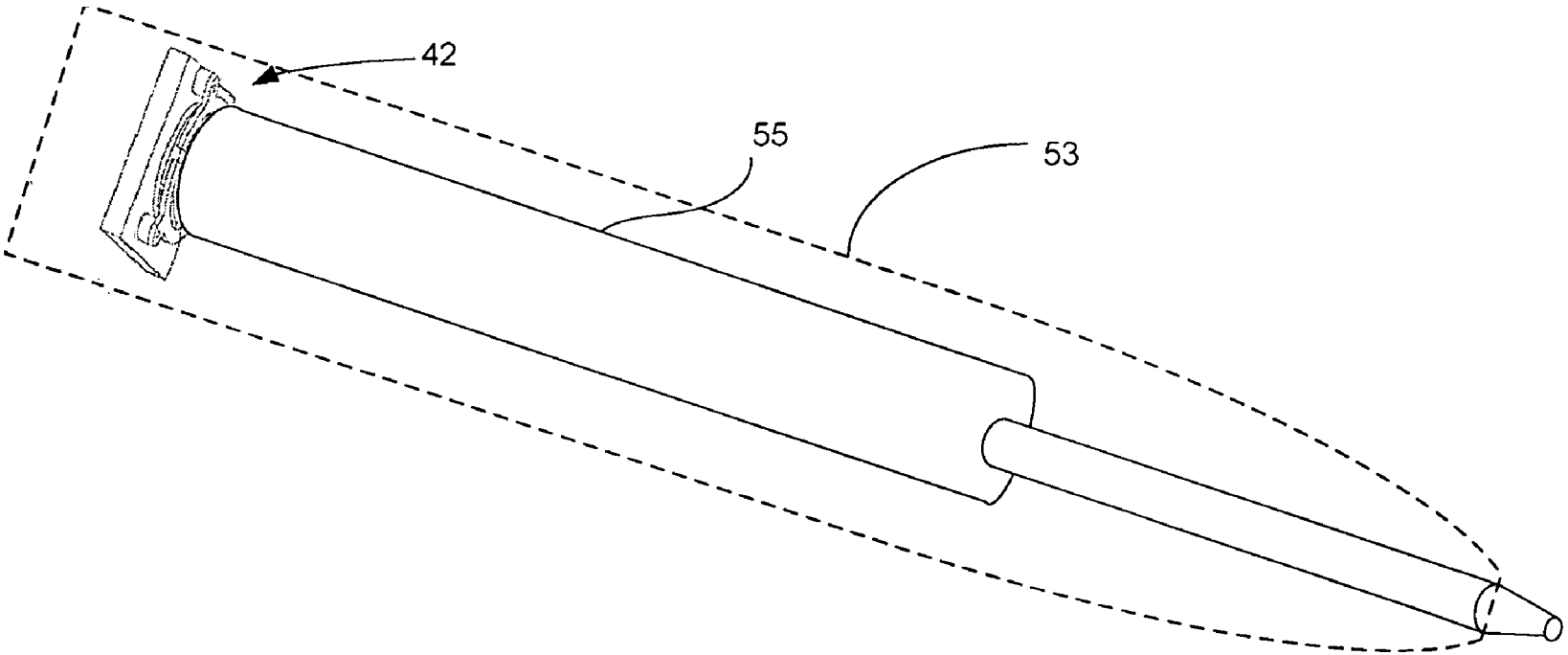
FIG. 6 illustrates a pen with a sensor assembly and a single nib structure, in accordance with various embodiments of the present invention.

Referring to FIG. 6, the previously described sensor assembly 42 employed in a pen 53 with a single nib structure 53 is illustrated in accordance with various alternative embodiments. As indicated earlier, the sensor assembly 42 may be used in an electronic pen 10 having multiple nib structures 30 as depicted in FIGS. 2 and 3, or it may be employed in a pen 53 having a single nib structure 55 as depicted in FIG. 6. In some embodiments, the pen 53 may be an electronic pen in which case the pen 53 would include additional electronics such as electronic circuitry and an imaging sensor that are not depicted in FIG. 3. In some embodiments, the nib structure 55 may be a stylus or an ink cartridge.

Referring once again to FIGS. 2 and 3, novel components and configurations are provided in accordance with various embodiments that allow the electronic pen 10 to function as a twist-type multi-ink pen with multiple cartridges and/or styluses while still having sufficient space within the pen housing to accommodate all the electronics needed in electronic pens. FIG. 7 is a cross sectional view of the previously described outer cylinder 14, the inner cylinder 40, and the main bodies 26 of the nib structures 30 in accordance with various embodiments of the present invention. As depicted, disposed on an interior surface 70 of the outer cylinder 14 is at least one inward protrusion ("protrusion") 72. The protrusion 72 may be a single unitary piece or multiple pieces. On an external surface 86 of the inner cylinder 40 is a post 76 that extends from the external surface 86 outwards away from the center axis 82 of the inner cylinder 40. Because the post 76 is disposed within the protrusion 72, the post 76 is engaged to the protrusion 72. Disposed also on the external surface 86 of the inner cylinder 40 are two bridging contacts 78A and 78B, which in this case are gradual ramps that may be used to close selective circuitry that may be included with the electronic pen 10. These and other aspects of the bridging contacts 78A and 78B will be described in greater detail below.

The inner cylinder 40 may be designed to be rotatable around its center axis 82 and may be coupled to the twist mechanism 24 to provide the rotational force needed by the twist mechanism 24 in order to selectively extend, one at a time, each of the nib structures 30. Similarly, the outer cylinder 14 may be rotatable around its own center axis 80. Because the post 76 is engaged to the protrusion 72, the inner cylinder 40 is engaged to the outer cylinder 14 such that the inner cylinder 40 and the outer cylinder 14 will rotate in unison when the outer cylinder 14 is rotated by, for example, a user.

As depicted, the center axis 82 of the inner cylinder 40 is offset from the center axis 80 of the outer cylinder 14. As a result, space 32 is available for electronics such as a circuit board, an image sensor, and/or other components. FIG. 7B illustrates a cutout side view of the inner cylinder 40 disposed within the outer cylinder 14 in accordance with various embodiments of the present invention. In this side view of the inner cylinder 40, the post 76 is partially disposed within the inner cylinder 40 in a hole 75, which may extend all the way to the back-wall of the inner cylinder 40. One of the main bodies 26 of the nib structures 30 is visible on the left side of the inner cylinder 40 (the other main body 26 being hidden behind the visible one). A biasing component 73 may be coupled to the post 76 that exerts an outward force on the post 76 urging the post 76 towards the interior surface 70 of the outer cylinder 14 to maintain engagement of the post 76 with the protrusion 72. In some embodiments, the biasing components 73 may be a spring or a coil or other elastic material. In FIG. 7B, only one of the bridging contacts 78A is clearly visible, the other bridging contact 78B (indicated by the dotted rectangle) is disposed mostly on the other side of the inner cylinder 40.

The bridging contacts 78A and 78B may be gradual ramps having elongated shapes that extend around the external surface 86 of the inner cylinder 40 and around the center axis 82 of the inner cylinder 40. The bridging contacts 78A and 78B may comprise of conductive material or materials. In embodiments where the bridging contacts 78A and 78B are gradual ramps, each of the gradual ramps 78A and 78B may be characterized by a first end having a first height with respect to the external surface 86, and a second end having a second height with respect to the external surface 86, wherein the first height is smaller than the second height. In some alternative embodiments, the bridging contacts 78A and 78B may have other form factors other than gradual ramps. For example, the bridging contacts 78A and 78B may merely be protrusions such as blocks in other alternative embodiments.

Figure 7A:
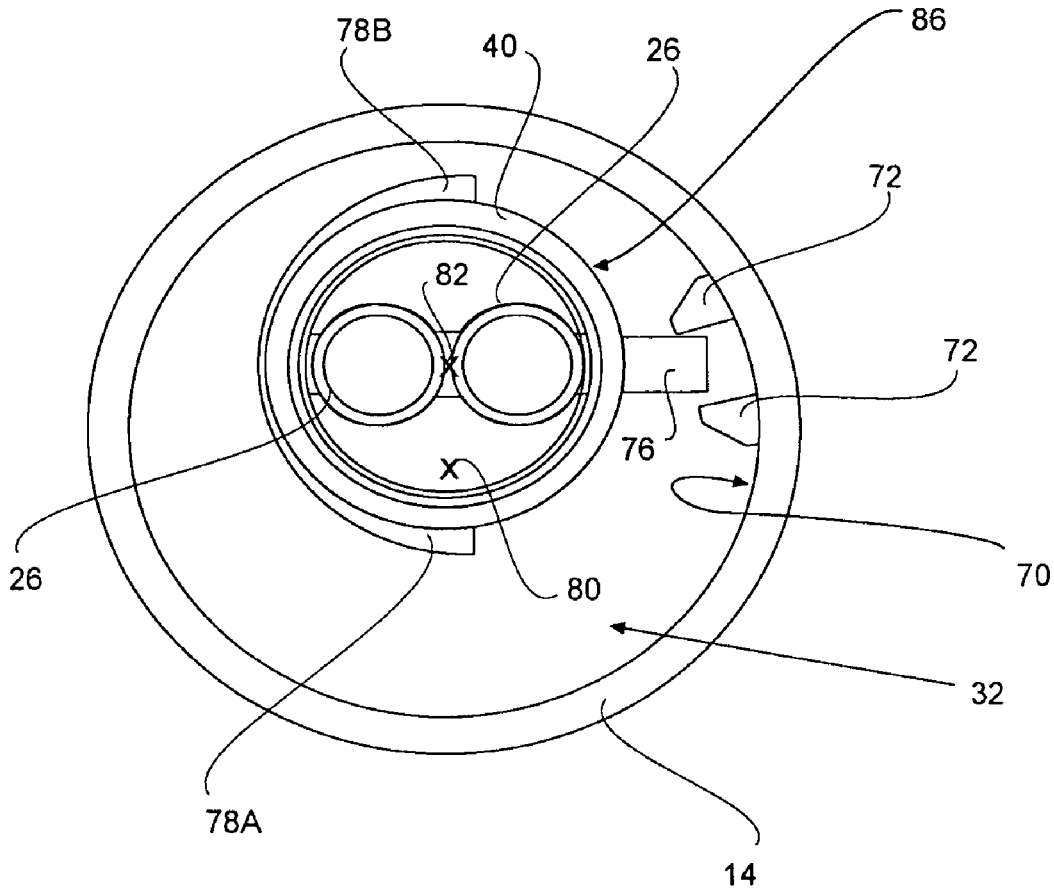
FIGS. 7A and 7B illustrate different views of an inner cylinder and an outer cylinder of the electronic pen of FIG. 1, in accordance with various embodiments of the present invention.
Figure 7B:
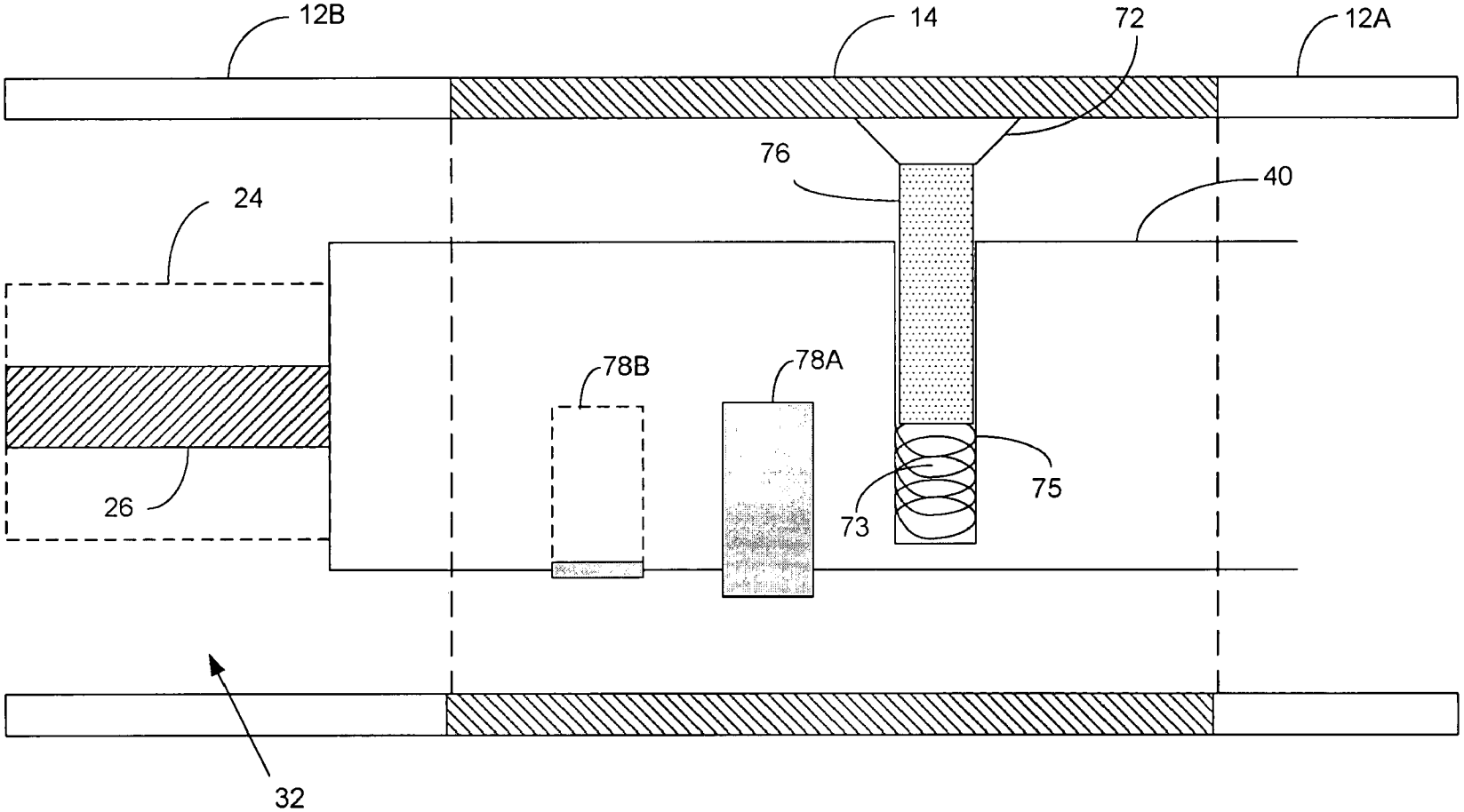
Figure 8:
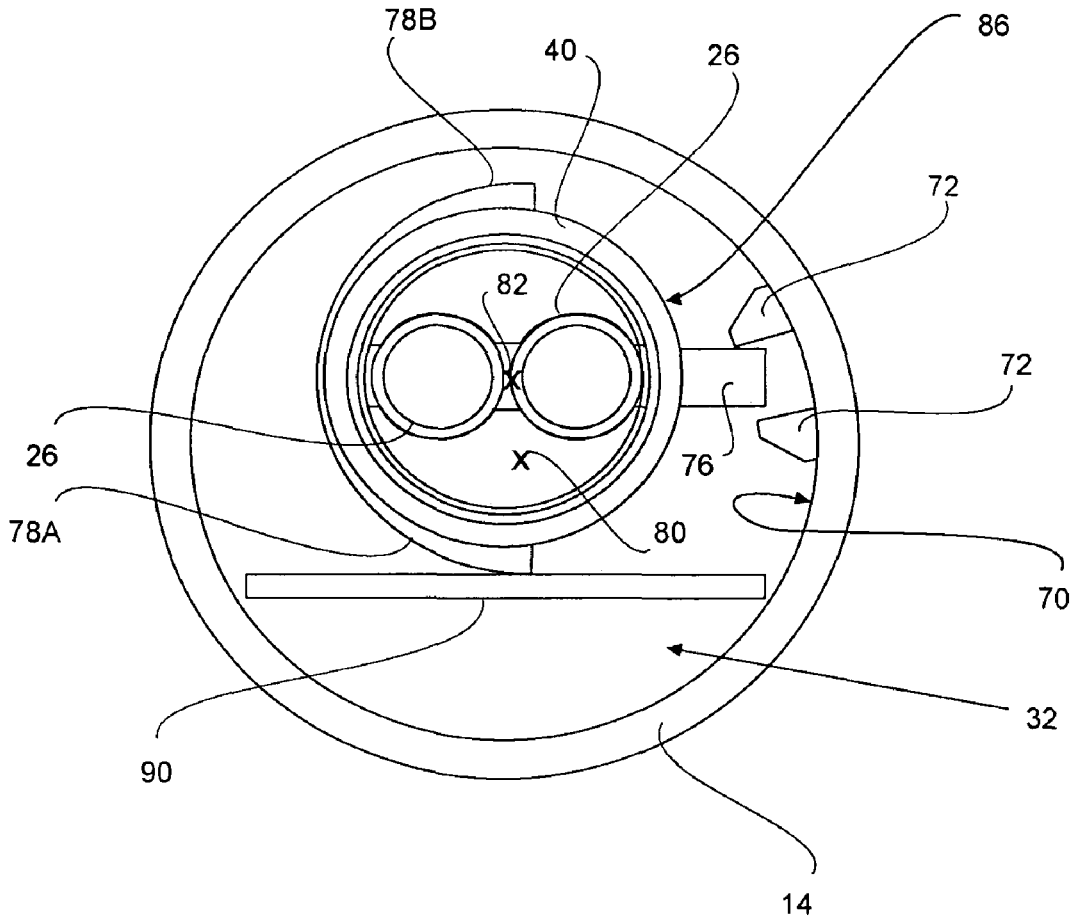
FIG. 8 illustrates the inner cylinder and the outer cylinder of FIGS. 7A and 7B with a circuit board, in accordance with various embodiments of the present invention.

FIG. 8 illustrates a portion of a circuit board 90 that has been placed adjacent to the inner cylinder 40 and in the space 32 illustrated in FIGS. 7A and 7B. Such a circuit board 90, which may be a printed circuit board, may include various electronic circuitries for processing data from an imaging sensor 20. In some embodiments, the imaging sensor 20 may be disposed on the circuit board 90. In the embodiment depicted in FIG. 8, the inner cylinder 40 has been rotated and positioned such that one of the contact bridges 78A is in contact with the circuit board 90.

In various embodiments, and as will be further described, the circuit board 90 may include at least a first and a second indicator circuit, each of the first and second indicator circuit may be designed to be closed when one of the bridging contacts 78A or 78B is in contact with the circuit board 90. When the first or the second indicator circuit is closed, they may provide an indication that one of the nib structures 30 that the indicator circuit is associated with has been extended. That is, in certain user applications, it may be desirable to know which of the nib structures 30 has been extended and deployed. For example, if the nib structures 30 include a stylus and an ink cartridge, it may be desirable to know whether the stylus or the ink cartridge has been deployed. To make such a determination, the first indicator circuit may be designed to provide an indication that the first of the two nib structures 30 has been extended (i.e., deployed) only when the first indicator circuit is a closed circuit. In contrast, the second indicator circuit may be designed to provide an indication that the second of the two nib structures 30 has been extended only when the second indicator circuit is a closed circuit. Since one of the bridging contacts 78A is shown to be in contact with the circuit board 90 in FIG. 7, one of the first or the second indicator circuit is closed in this illustration.

Figure 9:
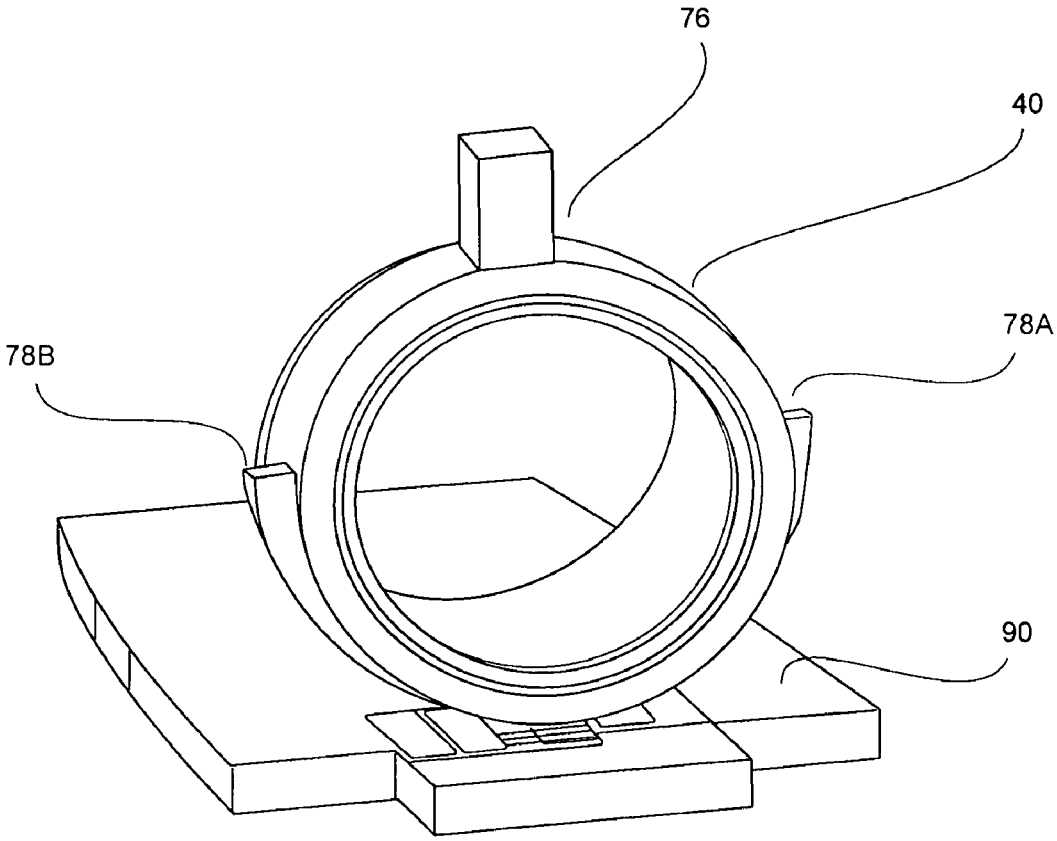
FIG. 9 illustrates a perspective view of the inner cylinder and the circuit board of FIG. 8, in accordance with various embodiments of the present invention.

FIG. 9 is a perspective view of the inner cylinder 40 and the circuit board 90 illustrated in FIG. 8 in accordance with various embodiments of the present invention. In FIG. 9, the inner cylinder 40 has been rotated and positioned in a neutral position such that neither of the bridging contacts 78A and 78B is in contact with the circuit board 90. In this position, both the first and second indicator circuits will be open circuits.

Figure 10A:
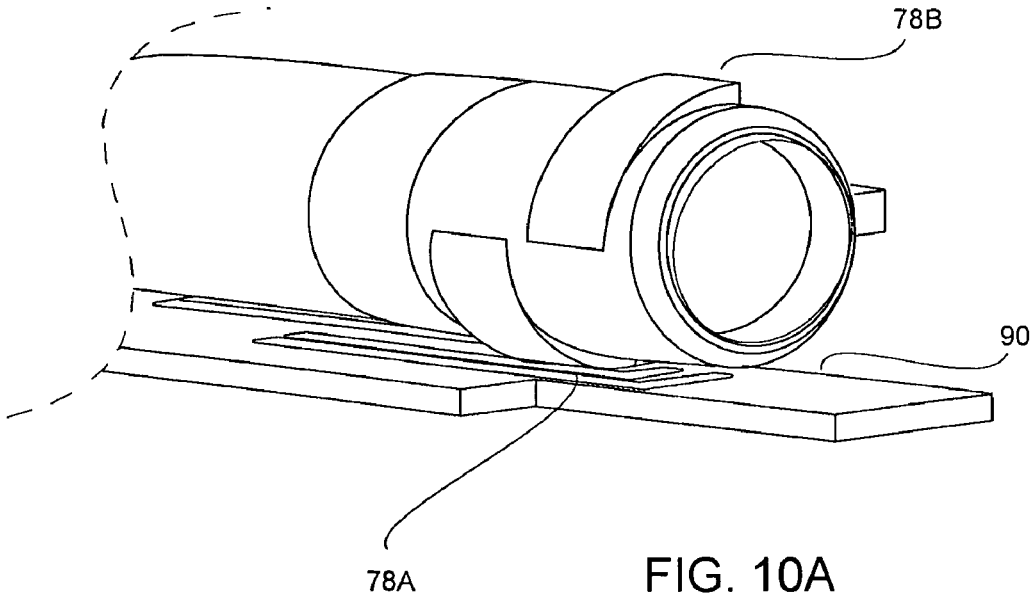
FIGS. 10A and 10B illustrate the inner cylinder and the circuit board of FIG. 9 when the inner cylinder has been rotated in a clockwise and counterclockwise direction, respectively, in accordance with various embodiments of the present invention.
Figure 10B:
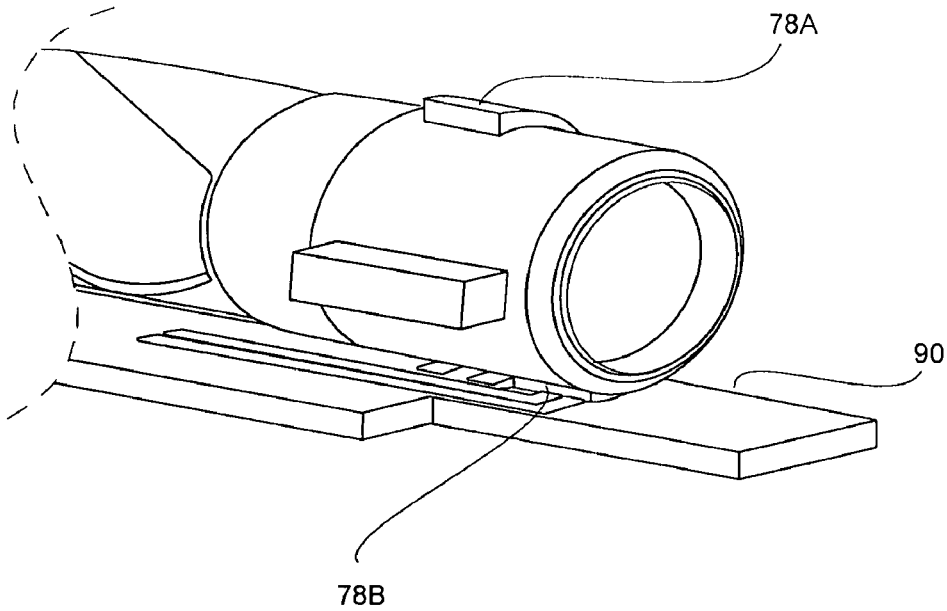

FIG. 10A is a different view of the inner cylinder 40 of FIG. 8 when the inner cylinder 40 has been rotated in a clockwise direction that results in the bridging contact 78A making contact with the circuit board 90. Consequently and as will be further described, one of the two indicator circuits such as the first indicator circuit may become a closed circuit. In contrast, FIG. 10B illustrates the inner cylinder 40 of FIG. 9 when the inner cylinder 40 has been rotated in a counterclockwise direction that results in the bridging contact 78B making contact with the circuit board 90. Consequently, the second indicator circuit may become a closed circuit.

Figure 11:
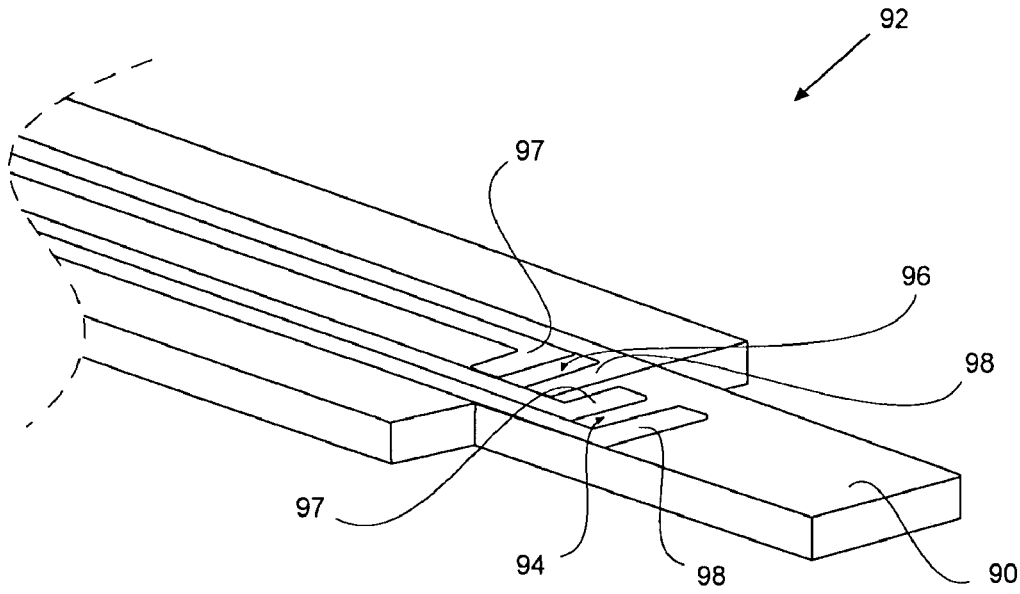
FIG. 11 illustrates a portion of the circuit board of FIGS. 9, 10A, and 10B, in accordance with various embodiments of the present invention.

FIG. 11 illustrates a portion of the circuit board 90 of FIG. 8 that may come in contact with the bridging contacts 78A and 78B when the inner cylinder 40 is rotated in accordance with various embodiments of the present invention. The portion 92 includes a first and a second trace pairs 94 and 96. Each trace pairs 94 and 96 further includes a first and a second trace 97 and 98, the first trace 97 being a predetermined distance away from the second trace 98. Although not depicted, the circuit board 90 may further include the previously described first and second indicator circuits to provide indications which if any of the first and second nib structures 30 have been extended. In order to provide for such functionality, the first trace pair 94 may be coupled to, for example, the first indicator circuit while the second trace pair 96 may be coupled to the second indicator circuit. In order to close the first indicator circuit, the inner cylinder 40 may be rotated in the clockwise direction (as depicted in FIG. 10A) such that the bridging contact 78A, which is aligned over trace pair 94, bridges the distance between traces 97 and 98 of trace pair 94 and is in contact with both of the traces 97 and 98. In contrast, in order to close the second indicator circuit, the inner cylinder 40 may be rotated in the counterclockwise direction (as depicted in FIG. 10B) such that the bridging contact 78B, which is aligned over trace pair 96, bridges the distance between traces 97 and 98 of trace pair 96 and is in contact with both of the traces 97 and 98. Thus, in accordance with various embodiments, the bridge contacts 78A and 78B may have widths that are equal to or greater than the distances between traces 97 and 98 of trace pairs 94 and 96.

Although the electronic pen 10 in the above described embodiments included only two nib structures 30, in alternative embodiments, the electronic pen 10 may include three or more nib structures 30. For these embodiments, the external surface 86 of the inner cylinder 40 would include, for each additional nib structure 30, an additional contact bridge. Thus, if there are three nib structures 30 included in the electronic pen 10, then three contact bridges and three indicator circuits would be needed. If there are four nib structures 30 included in the electronic pen 10, then four contact bridges and four indicator circuits would be needed, and so forth.

Figure 12:
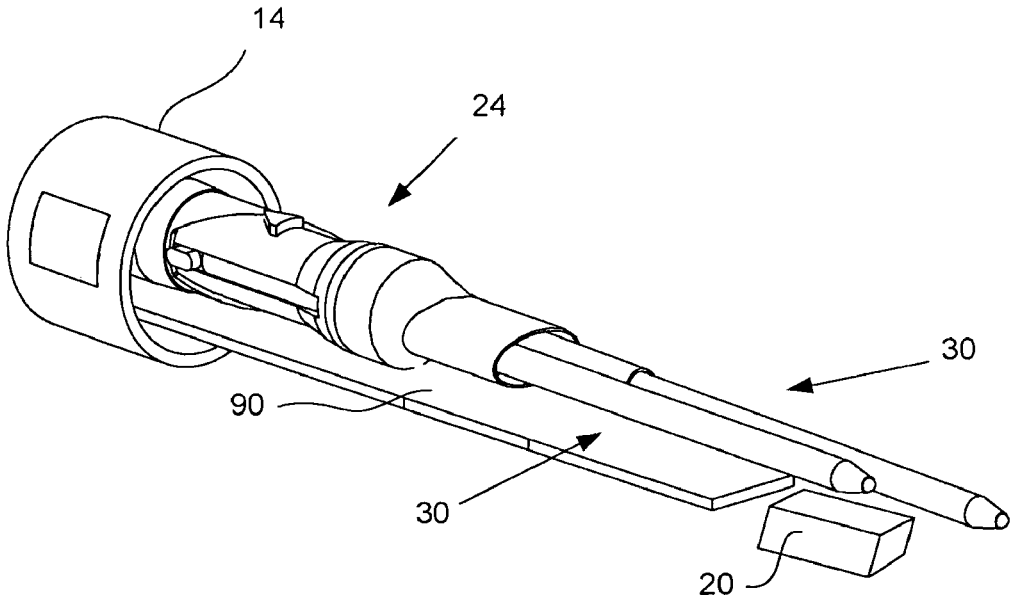
FIG. 12 illustrates the circuit board of FIG. 11 with respect to nib structures and twist mechanism of the electronic pen of FIG. 1, in accordance with various embodiments of the present invention.

FIG. 12 is an overall perspective view of the circuit board 90 illustrated in FIG. 10 with respect to the previously described twist mechanism 24 and nib structures 30, in accordance with various embodiments of the present invention. An imaging sensor 20 may be coupled to the circuit board 90. Alternatively, the imaging sensor 20 may be disposed on the circuit board 90. At least a portion of the circuit board 90 may be disposed within the outer cylinder 14. As described earlier, the circuit board may include at least a first and a second indicator circuit.

Although specific embodiments have been illustrated and described herein, it will be appreciated by those of ordinary skill in the art and others, that a wide variety of alternate and/or equivalent implementations may be substituted for the specific embodiments illustrated and described without departing from the scope of the present invention. This application is intended to cover any adaptations or variations of the embodiments discussed herein. Therefore, it is manifested and intended that various embodiments of the invention be limited only by the claims and the equivalents thereof.

What is claimed is:

1. An apparatus, comprising:

a first nib structure including a first main body having a first end and a second end, the first end being opposite the second end, the first nib structure further including a first nib coupled to the first end;

a second nib structure including a second main body having a first end and a second end, the first end being opposite the second end, and a second nib coupled to the first end;

a twist mechanism coupled to the second ends of the first and second nib structures to selectively extend the first or the second nib structure away from the twist mechanism;

an inner cylinder coupled to the twist mechanism and having a first center axis; and an outer cylinder surrounding the inner cylinder and coupled to the inner cylinder to move the inner cylinder in a rotational direction when the outer cylinder is rotated, said outer cylinder having a second center axis, and the first center axis of the inner cylinder being offset from the second center axis of the outer cylinder.

2. The apparatus of claim 1, wherein the inner cylinder having an external surface and a post that extends from the external surface outwards away from the first center axis, and the outer cylinder includes an interior surface and one or more protrusions disposed on the interior surface and configured to engage the post to facilitate in the movement of the inner cylinder in the rotational direction.

3. The apparatus of claim 2, wherein at least a portion of said post is disposed within the inner cylinder and coupled to a biasing component that exerts an outward force on the post urging the post towards the interior surface of the outer cylinder to maintain engagement of the post with the one or more protrusions.

4. The apparatus of claim 3, wherein said biasing component is a spring.

5. The apparatus of claim 1, further comprising an external barrel housing that surrounds at least the first and second main bodies of the first and second nib structures.

6. The apparatus of claim 5, further comprising an imaging sensor disposed within the external barrel housing.

7. The apparatus of claim 6, further comprising circuitry disposed within the external barrel housing and coupled to the imaging sensor.

8. The apparatus of claim 1, wherein the first nib structure is an ink cartridge.

9. The apparatus of claim 8, wherein the second nib structure is another ink cartridge or a stylus.

10. An apparatus, comprising:

a first nib structure including a first main body having a first end and a second end, the first end being opposite the second end, the first nib structure further including a first nib coupled to the first end;

a second nib structure including a second main body having a first end and a second end, the first end being opposite the second end, and a second nib coupled to the first end;

a twist mechanism coupled to the second ends of the first and second nib structures to selectively extend the first or the second nib structure away from the twist mechanism in response to a rotational force;

an inner cylinder coupled to the twist mechanism, the inner cylinder having a center axis and configured to rotate around the center axis to transfer the rotational force to the twist mechanism, the inner cylinder further having an external surface and having a first and a second bridging contact disposed on the external surface; and a circuit board including a first circuit to provide an indication that the first nib structure has been extended from the twist mechanism when the first circuit is a first closed circuit and a second circuit to provide an indication that the second nib structure has been extended from the twist mechanism when the second circuit is a second closed circuit, wherein the first bridging contact is configured to close the first circuit when the inner cylinder is rotated in a first rotational movement and the second bridging contact is configured to close the second circuit when the inner cylinder is rotated in a second rotational movement.

11. The apparatus of claim 10, wherein the first circuit includes a first and a second trace that are separated by at least a first distance and the second circuit includes a third and a fourth trace that are separated by a second distance, and wherein the first bridging contact is disposed on the external surface of the inner cylinder having a width that is equal to or greater than the first distance and the second bridging contact is disposed on the external surface of the inner cylinder having a width that is equal to or greater than the second distance.

12. The apparatus of claim 10, wherein the first and second bridging contacts are a first and a second gradual ramp, respectively, disposed on the external surface of the inner cylinder, the first and second gradual ramps having elongated shapes that extend around the external surface of the inner cylinder and around the center axis of the inner cylinder.

13. The apparatus of claim 12, wherein each of the elongated shapes of the first and second gradual ramps has a first and a second end, the first end having a first height with respect to the external surface and the second end having a second height with respect to the external surface, the first height being smaller than the second height.

14. The apparatus of claim 10, wherein the first and second bridging contacts comprise a conductive material.

15. The apparatus of claim 10, further comprising an outer cylinder surrounding the inner cylinder and coupled to the inner cylinder to move the inner cylinder in a rotational direction when the outer cylinder is rotated.

16. The apparatus of claim 15, further comprising an external barrel housing that surrounds at least the first and second main bodies of the first and second nib structures and the circuit board.

17. The apparatus of claim 10, further comprising an imaging sensor coupled to the circuit board.

18. An apparatus, comprising:

a first nib structure including a first main body having a first end and a second end, the first end being opposite the second end, the first nib structure further including a first nib coupled to the first end;

a second nib structure including a second main body having a first end and a second end, the first end being opposite the second end, and a second nib coupled to the first end;

a twist mechanism coupled to the second ends of the first and second nib structures to selectively extend the first or the second nib structure away from the twist mechanism in response to a rotational force;

an inner cylinder coupled to the twist mechanism, the inner cylinder having a first center axis and configured to rotate around the first center axis to transfer the rotational force to the twist mechanism, the inner cylinder further having an external surface and having a first and a second bridging contact disposed on the external surface;

an outer cylinder surrounding the inner cylinder and coupled to the inner cylinder to move the inner cylinder in a rotational direction when the outer cylinder is rotated, said outer cylinder having a second center axis, and the first center axis of the inner cylinder being offset from the second center axis of the outer cylinder; and a circuit board including a first circuit to provide an indication that the first nib structure has been extended from the twist mechanism when the first circuit is a first closed circuit and a second circuit to provide an indication that the second nib structure has been extended from the twist mechanism when the second circuit is a second closed circuit, wherein the first bridging contact is configured to close the first circuit when the inner cylinder is rotated in a first rotational movement and the second bridging contact is configured to close the second circuit when the inner cylinder is rotated in a second rotational movement.

19. The apparatus of claim 18, further comprising a sensor coupled to the twist mechanism to measure more than two levels of force being applied to the first or the second nib.

20. The apparatus of claim 19, wherein the sensor is a capacitive force sensor having a first plate and a second plate, the second plate being parallel to the first plate and being at a standoff distance away from the first plate, the first plate having a first side that is facing the second plate and a second side that is opposite of the first side and coupled to the second end of the first nib structure.

21. The apparatus of claim 18, wherein the inner cylinder includes an external surface and a post that extends from the external surface outwards away from the first center axis, and the outer cylinder includes an interior surface and one or more protrusions disposed on the interior surface and configured to engage the post to facilitate in the movement of the inner cylinder in the first and second rotational directions.

22. The apparatus of claim 18, wherein the first circuit includes a first and a second trace that are separated by at least a first distance and the second circuit includes a third and a fourth trace that are separated by a second distance, and wherein the first bridging contact is disposed on the external surface of the inner cylinder having a width that is equal to or greater than the first distance and the second bridging contact is disposed on the external surface of the inner cylinder having a width that is equal to or greater than the second distance.

23. The apparatus of claim 18, wherein the first and second bridging contacts are a first and a second gradual ramp, respectively, disposed on the external surface of the inner cylinder, the first and second gradual ramps having elongated shapes that extend around the external surface of the inner cylinder and around the center axis of the inner cylinder.

* * * * *